US007837219B1

(12) United States Patent
Cordes

(10) Patent No.: US 7,837,219 B1
(45) Date of Patent: Nov. 23, 2010

(54) BINDING ASSEMBLY FOR A SPORTS BOARD

(76) Inventor: David W. Cordes, 11 Gary Dr., Westfield, MA (US) 01085

( * ) Notice: Subject to any disclaimer, the term of this patent is extended or adjusted under 35 U.S.C. 154(b) by 584 days.

(21) Appl. No.: 11/765,505

(22) Filed: Jun. 20, 2007

(51) Int. Cl.
*A63C 9/08* (2006.01)

(52) U.S. Cl. ..... 280/618; 280/14.24

(58) Field of Classification Search ..... 280/607, 280/618, 14.21, 14.24, 611, 11.36, 620, 623
See application file for complete search history.

(56) References Cited

U.S. PATENT DOCUMENTS

| | | | | |
|---|---|---|---|---|
| 5,667,237 | A * | 9/1997 | Lauer | 280/607 |
| 5,791,678 | A * | 8/1998 | Perlman | 280/618 |
| 5,826,910 | A * | 10/1998 | Ricks et al. | 280/618 |
| 5,868,416 | A | 2/1999 | Fardie | |
| 5,890,729 | A * | 4/1999 | Bayer et al. | 280/618 |
| 5,947,488 | A * | 9/1999 | Gorza et al. | 280/14.21 |
| 5,984,325 | A * | 11/1999 | Acuna | 280/14.24 |
| 6,022,041 | A * | 2/2000 | Dailey et al. | 280/618 |
| 6,065,767 | A * | 5/2000 | Girotto et al. | 280/607 |
| 6,155,578 | A * | 12/2000 | Patterson | 280/14.24 |
| 6,257,614 | B1 | 7/2001 | Duggan | |
| 6,302,411 | B1 | 10/2001 | Huffman et al. | |
| 6,318,749 | B1 * | 11/2001 | Eglitis et al. | 280/607 |
| 6,467,794 | B1 * | 10/2002 | De France | 280/607 |
| 6,575,489 | B1 * | 6/2003 | White | 280/613 |
| 6,905,133 | B2 | 6/2005 | Lett | |
| 6,910,706 | B2 | 6/2005 | Holzer et al. | |
| 6,916,036 | B1 | 7/2005 | Egli | |
| 6,994,370 | B2 | 2/2006 | Sabol | |
| 7,090,228 | B2 | 8/2006 | Reynolds | |
| 7,097,195 | B2 | 8/2006 | Orr et al. | |
| 2002/0063404 | A1 * | 5/2002 | Lafond | 280/14.21 |
| 2003/0230870 | A1 | 12/2003 | Sabol | |
| 2006/0091622 | A1 | 5/2006 | Sabol | |
| 2007/0007735 | A1 | 1/2007 | Stefanic | |

FOREIGN PATENT DOCUMENTS

| | | |
|---|---|---|
| EP | 1329246 | 7/2003 |
| WO | WO 2005123202 | 12/2005 |

* cited by examiner

*Primary Examiner*—J. Allen Shriver, II
*Assistant Examiner*—Bridget Avery
(74) *Attorney, Agent, or Firm*—Doherty Wallace Pillsbury & Murphy

(57) ABSTRACT

A binding assembly comprising a binding which comprises a boot platform and a positioning unit, wherein the positioning unit secures the binding assembly to a sports board. The positioning unit comprises an anchoring subunit comprising a central member; and a locking subunit comprising a handle in communication with an engaging member. At one moment the handle exerts a first force on the engaging member thereby causing the engaging member to move towards the central member until the engaging member is in contact with the central member, at which point the handle is maneuvered to lock the binding assembly into position. At another moment, the handle exerts a second force on the engaging member thereby causing the engaging member to move away from the central member, thereby unlocking the binding assembly. When unlocked, the binding is rotatable about a central longitudinal axis, and when unlocked, the binding is fixed in position.

13 Claims, 7 Drawing Sheets

BINDING ASSEMBLY FOR A SPORTS BOARD

BACKGROUND OF THE INVENTION

1. Field of the Invention

The present invention relates to sporting boards, and more particularly to adjustable rotatable bindings positioned on sports boards, wherein the bindings are rotatable between a pre-set arc distance.

2. Background

Sports boards such as, for example waterboards, snowboards, wakeboards, skateboards, surfboards, sailboards and skateboard-type devices adapted for use on ice surfaces, may be used in sky, ground, water, ice, and snow related sports. Such sports boards typically use bindings to hold shoes or boots of a user to the board; the bindings are normally screwed onto the board in a permanent orientation that is almost perpendicular to the direction of travel of the board. This orientation is good for riding downhill on a snowboard, but may be uncomfortable when traveling over a flat or uphill snow contour, when it may be necessary to release the back boot and use that boot to propel the board. Having the front boot nearly perpendicular to the board with the board and back foot moving forward is uncomfortable and potentially dangerous because a fall in this orientation may injure the ankle or knee joints of the user. Furthermore, on a chairlift, having the foot nearly perpendicular to the board causes the board to be positioned across the front of the chair which may make mounting and dismounting the chairlift awkward, and may disturb or interfere with an adjacently seated rider. It would be advantageous, therefore, to provide a binding mount that allows for the ready adjustment of the binding's position on the sports board.

SUMMARY OF THE INVENTION

The above problems and difficulties are alleviated by a binding assembly mounted on a sports board, wherein the binding assembly comprises a binding that is rotatable about an anchoring subunit. The binding assembly further comprises a locking subunit that is joined to the binding, and which, when engaged with the anchoring subunit, locks the binding into position, and which, when not engaged with the anchoring subunit, allows the binding to be rotated when a predetermined threshold of rotational force is applied to the binding.

Additionally, in an exemplary embodiment, the anchoring subunit further comprises one or more stops, wherein the stops create a maximum range of motion through which the binding can be rotated. The position of the stops may be adjusted so that the binding's range of motion can be altered to the preferences of a particular user.

The binding assembly of the present invention is particularly advantageous in that it allows a boot platform to be rotated between one or more stops by simply unlocking the binding and applying a rotational force to the boot platform. Additionally, the positioning unit of the present invention is incorporated into the binding itself, rather than being mounted to the sports board independently from the binding as is taught by the prior art, thereby creating a unique and novel approach to the problems associated with rotating a user's foot in relation to a sports board.

Other objects and advantages of the present invention will become obvious to persons of ordinary skill in the art, and it is intended that these objects and advantages are within the scope of the present invention.

DETAILED DESCRIPTION OF THE INVENTION

Figure 1:
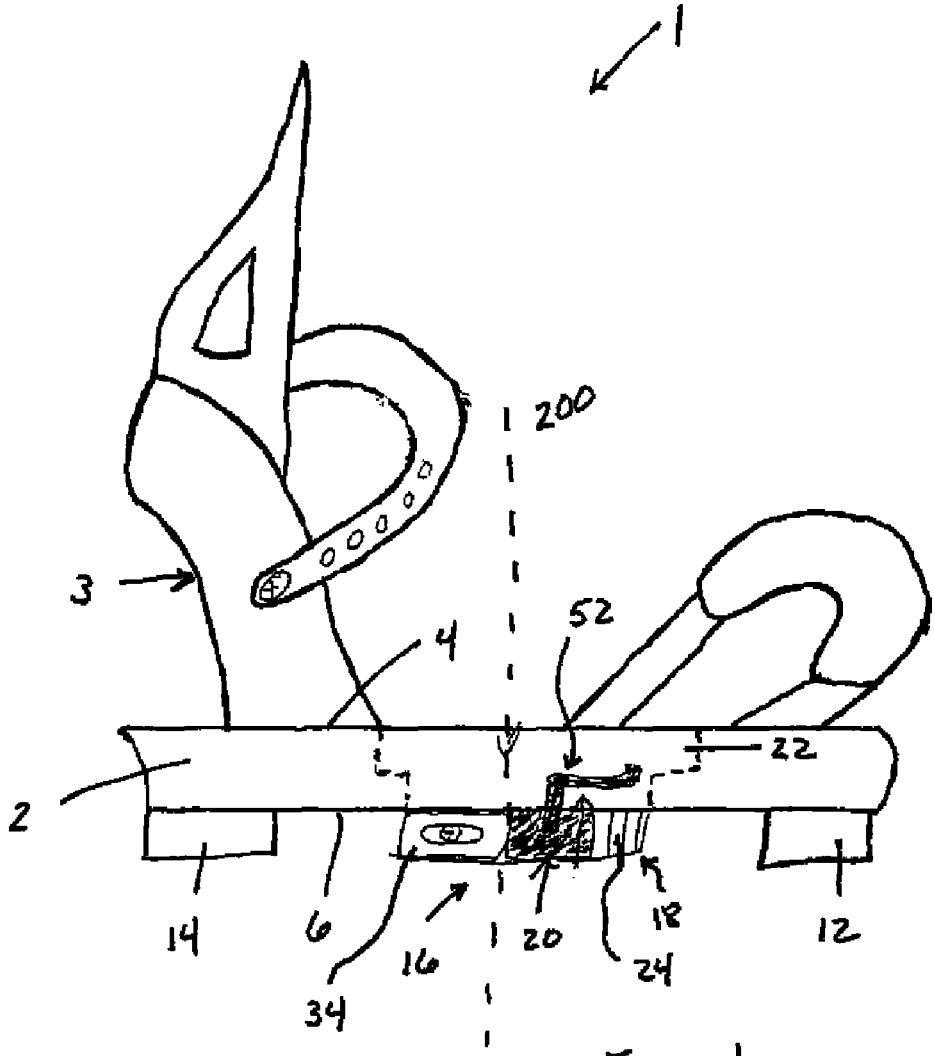
FIG. 1 is a schematic depicting an exemplary binding assembly.

The binding assembly of the present invention is mountable on a snowboard or other like sporting board (collectively referred to herein as "board"). The binding assembly comprises a positioning unit mounted at least partially within a binding. The positioning unit comprises an anchoring subunit in communication with a locking subunit, wherein the two subunits work in association with each other to reversibly alter and temporarily fix the position of the binding, and, hence, the position of a user's foot on the board.

The anchoring subunit comprises a plate positioned atop a central member, wherein, when the binding assembly is "unlocked", the binding is rotatable around the anchoring subunit in response to a rotational force applied to the binding, e.g., in response to the rotational movement of the user's foot. The anchoring subunit further comprises one or more stops which provide a physical boundary to the rotational movement of the binding. The stop(s) is positioned on a side wall of the central member. Although the stop(s) may be placed anywhere along the side wall of the central member to create a desired range of motion, in an exemplary embodiment, two stops are arranged on the side wall of the central member such that the position of the binding may be altered between the zero degree position and the ninety degree position of the board. Furthermore, in an exemplary embodiment, the position of the stop(s) on the central member is adjustable. That is, each stop and the side wall of the central member is preferably configured to provide for the non-permanent securement of the stop to the central member such that the position of the stop can be altered to an infinite number of positions and placed at alternative spots on the central member. In this way, a user can alter the range of motion of the binding, and, hence, the position of the user's foot on the board. Once the stops are fastened to the central member, the degree of rotation between the stops is repeatable, i.e., the binding can rotate back and forth between the stop(s).

The locking subunit locks and unlocks the anchoring subunit. In the "locked" position, the locking subunit prevents the binding from rotating, and in the "unlocked" position, the locking subunit allows the binding to rotate. The locking subunit accomplishes its primary purpose of locking and unlocking the binding via an engaging member in communication with a handle. When the binding is in the locked position, the engaging member is connected to the side wall of the central member of the positioning unit, and when the binding is in the unlocked position, the engaging member is no longer connected to the side wall of the positioning unit's central member. Such connection between the engaging member and the central member is accomplished via the handle, wherein the position of the handle relative to the binding generates a force, which, as will be discussed more fully below, ultimately drives the movement of the engaging member either towards or away from the central member.

In application, as the engaging member disconnects from the central member, the handle generates and stores a force. The disconnect between the engaging member and the central member allows for the rotation of the binding when a rotational force is applied to the binding. Rotation may continue until a lateral side of the engaging member makes contact with a stop. Once this contact is made, and because presumably a user has set the stop at a desired location, the binding is now positioned according to a user's preference. At this point, the handle is manipulated to release the stored force generated by the handle, wherein the release of this force, causes the engaging member to again contact the central member, wherein such contact prevents further rotation of the central member, at least until the handle is again manipulated to remove the engaging member from the central member.

Additionally, in an exemplary embodiment, the locking subunit may further comprise a pair of blocks, wherein one of the blocks from the pair abuts a lateral side of the engaging member and the other block from the pair abuts the opposite lateral side of the engaging member. The blocks serve to buffer the engaging member from contact with the stop, thereby, reducing the likelihood of damage to the engaging member and/or the stop. The blocks also serve to guide the direction of the engaging member as the engaging member moves towards and away from the central member.

An exemplary binding assembly will be discussed with reference to the figures, wherein it is to be understood that the invention is not restricted to the embodiments depicted in the figures. Rather, the inventive binding assembly encompasses all natural and obvious variations to the embodiment disclosed herein as would occur to a person of ordinary skill in the art.

Referring to FIG. 1, an exemplary binding assembly 1 comprises a binding 3 and a positioning unit 16. Binding 3 comprises a boot platform 2 having a top side 4 opposite to a bottom side 6. Binding 3 further comprises a toe block 12 and a heel block 14, wherein positioning unit 16 is disposed between toe and heel blocks 12 and 14.

Figure 2A:
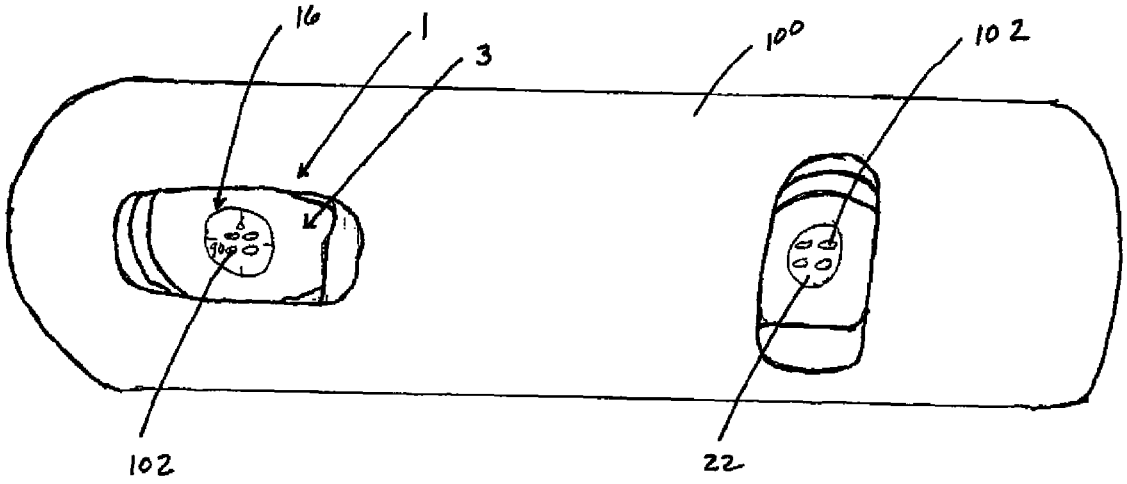
FIGS. 2*a* and 2*b* are schematics depicting exemplary forward and rearward bindings mounted on an exemplary board, wherein the bindings in FIG. 2*a* are set at a walking position and the bindings in FIG. 2*b* are set at a riding position.
Figure 2B:
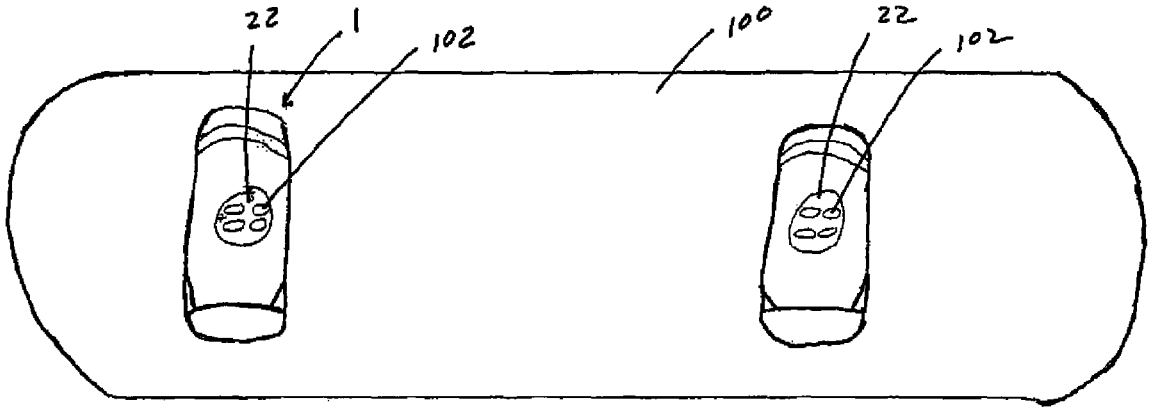
Figure 3:
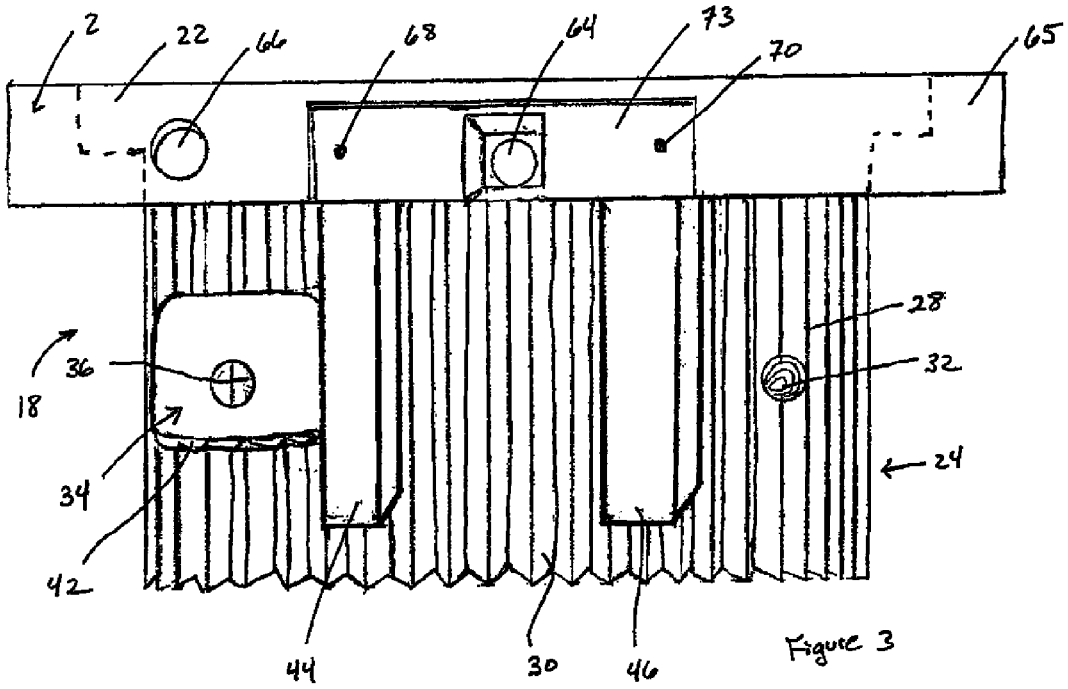
FIG. 3 is a schematic depicting a side view of a portion of an exemplary positioning unit positioned in relation to an exemplary boot platform of a binding.
Figure 4:
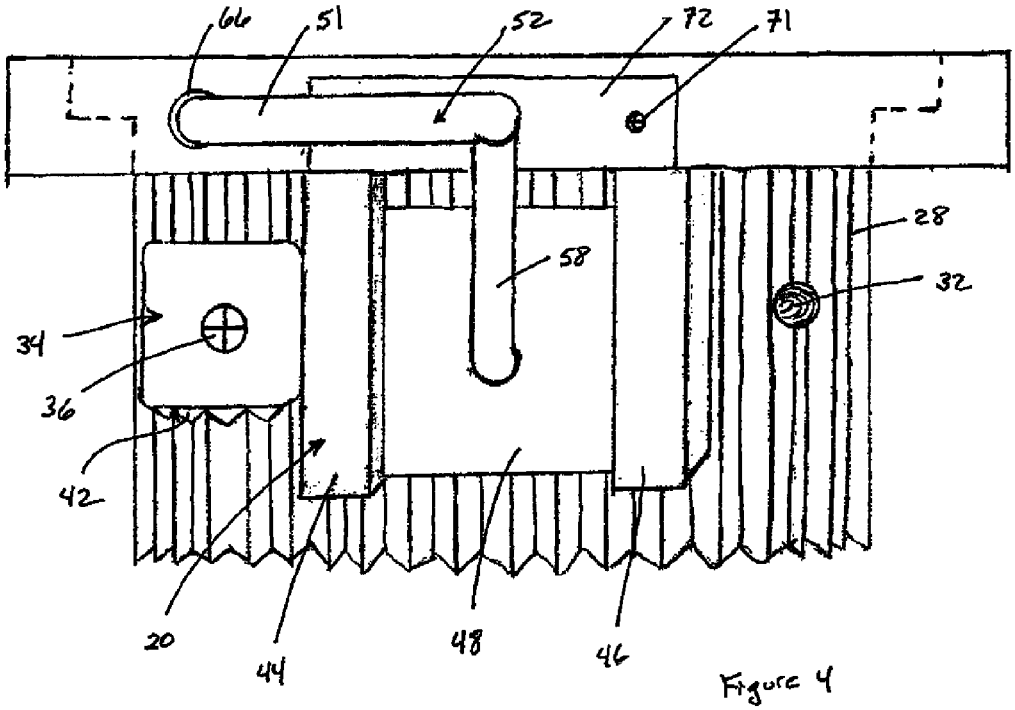
FIG. 4 is a schematic depicting a side view of an exemplary positioning unit positioned in relation to an exemplary boot platform of a binding.

Referring to FIGS. 1, 3, and 4, positioning unit 16, which is mounted to a board 100 via screwholes (not shown) and complementary screws 102 (see FIG. 2), extends from boot platform 2, and comprises an anchoring subunit 18 and a locking subunit 20.

Anchoring subunit 18 comprises a plate 22 atop a central member 24. Plate 22 is flush with top side 4 of boot platform 2. In operation, when positioning unit 16 is "unlocked", a rotational force is applied to boot platform 2, e.g., a snowboarder rotates his foot from the zero degree position (see FIG. 2*b*) to the ninety degree position (see FIG. 2*a*), thereby causing binding 3 to rotate in the direction of the rotational force about a longitudinal axis 200.

Central member 24 comprises a plurality of longitudinally extending grooves 30 sequentially spaced along a side wall 28. Additionally, central member 24 comprises a plurality of screw holes 32 spaced along side wall 28, the purpose of which is explained below.

Anchoring subunit 18 further comprises a plurality of stops 34 attached to side wall 28. In the exemplary embodiment depicted in the figures, each of stops 34 comprises a screw hole (not shown), which, when aligned with respective screw hole 32 formed in side wall 28, allows for the insertion of a screw 36 which secures stop 34 to side wall 28 of central member 24. However, it is to be understood that the method of fixing the stop to the side wall is not limited to a screw inserted into screw holes, but may be accomplished by any one or more of a variety of securing members. Additionally, to further enhance and strengthen the connection between side wall 28 and stops 34, each of stops 34 may further comprise a face comprising a plurality of ridges 42, which are complementary to plurality of grooves 30 located on side wall 28 of central member 24, and which therefore fit within plurality of grooves 30.

Figure 5:
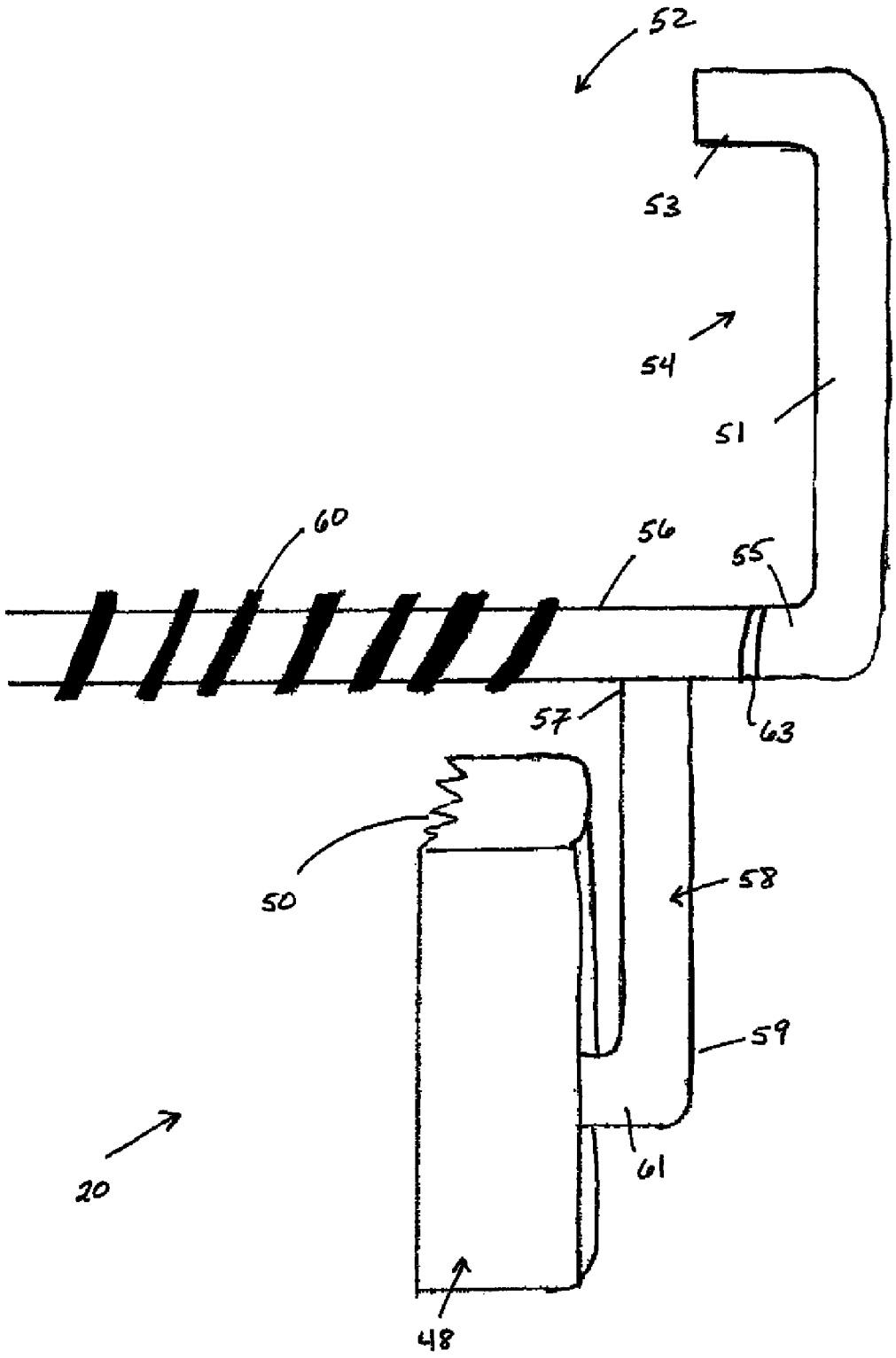
FIG. 5 is a schematic depicting an exemplary handle attached to an exemplary engaging member.

Referring to FIGS. 4 and 5, locking subunit 20 comprises blocks 44 and 46 abutting an engaging member 48. Engaging member 48 comprises a plurality of ridges 50 that, when engaging member 48 is interconnected with side wall 28 of central member 24, fit within plurality of grooves 30 of side wall 28.

Referring to FIG. 5, locking subunit 20 further comprises a handle 52. Handle 52 comprises a pull lever 54, an extension 56, and an extension 58. Pull lever 54 comprises a main body 51, an upper protrusion 53, and a lower protrusion 55, wherein upper and lower protrusions 53 and 55 are perpendicularly connected to main body 51. Extension 56 is joined to lower protrusion 55 of pull lever 54 via a swivel joint 63, and lies in a same plane as lower protrusion 55. Extension 58 comprises a first end 57 perpendicularly attached to extension 56 and extending therefrom to terminate at a second end 59. Extension 58 further comprises a protrusion 61 perpendicularly connected to second end 59. Handle 52 further comprises a coil compression spring 60, which is disposed over an outer surface of extension 56.

Referring to FIGS. 3 and 5, boot platform 2 comprises a port 64 for the insertion of extension 56. Port 64 is contained within a recessed portion 73 of boot platform 2 located on a side wall 65 of boot platform 2. Recessed portion 73 comprises screw holes 68 and 70, which in association with screws 71, secure a cover plate 72 (see FIG. 4) over recessed portion 73. Cover plate 72 comprises a port (not shown), which, when cover plate 72 is properly positioned on boot platform 2, is aligned with port 64. Accordingly, when extension 56 of handle 52 is securely positioned into port 64, coil compression spring 60 is contained on extension 56 between cover plate 72 and positioning unit 16.

Referring to FIGS. 3 and 4, boot platform 2 further comprises a port 66 for the insertion of upper protrusion 53 of pull lever 54. In an exemplary embodiment, when handle 52 is not in use, upper protrusion 53 may be at least partly inserted into port 66 such that handle 52 is tucked towards binding 3 and, hence, does not pose as an obstruction to a user.

In application, locking subunit 20 works in association with anchoring subunit 18 to rotate the position of binding 3. That is, binding 3, which is mounted on a board 100 via screws 102 inserted through screwholes 103 located on plate 22 of anchoring subunit 18, may be rotated, for example, from a zero degree position, e.g., a riding position (see FIG. 2*b*), to a ninety degree position, e.g., a walking position (see FIG.

2*a*). An exemplary method of operating the binding assembly is discussed below with reference to the figures.

Referring to FIGS. 4-6 and 9, when in a "locked" position, block 46 of locking subunit 20 abuts stop 34 and plurality of ridges 50 of engaging member 48 are engaged with plurality of grooves 30 positioned along side wall 28 of central member 24. Coil compression spring 60 is in a relaxed position.

Figure 7:
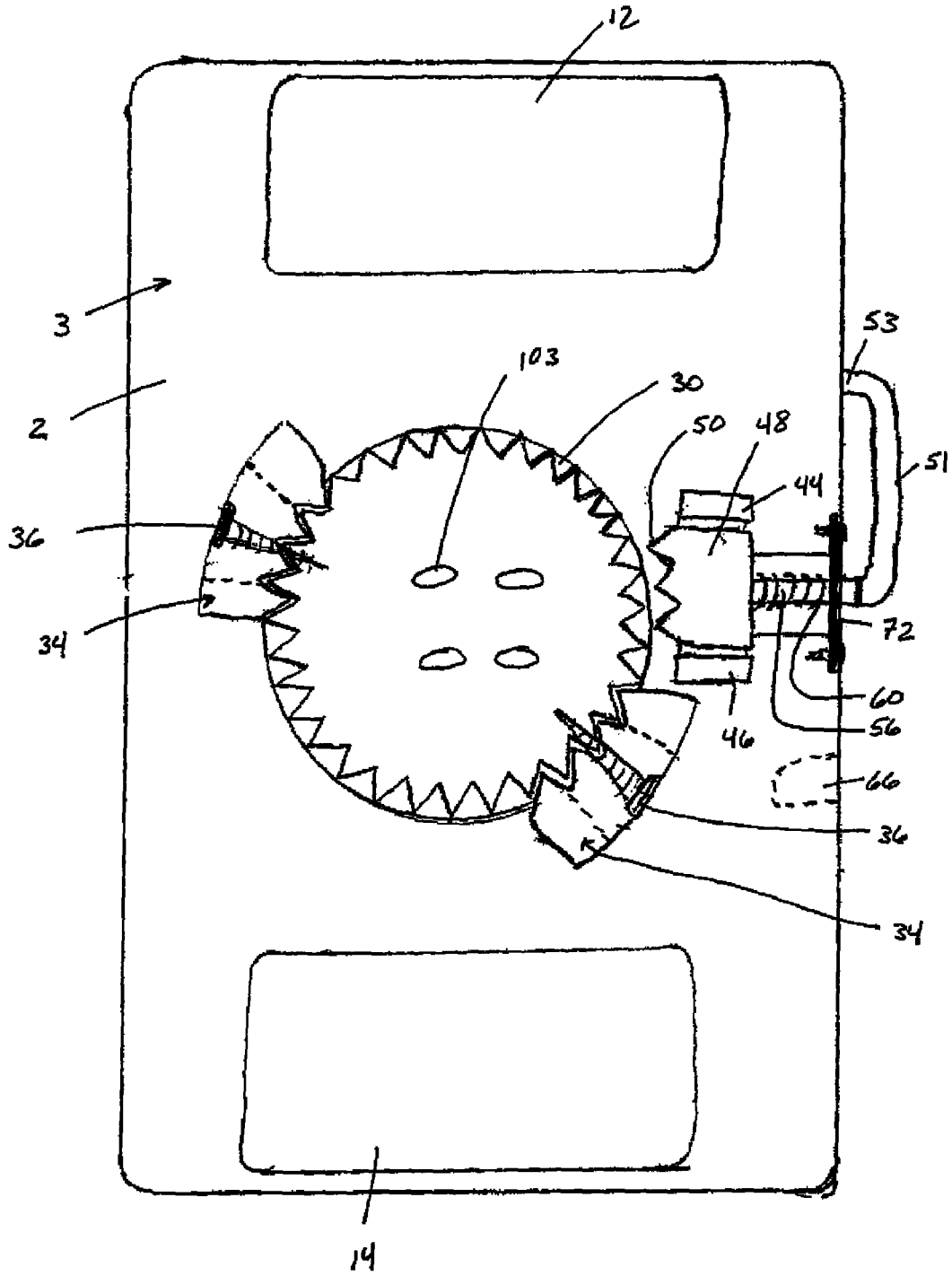
FIG. 7 is a schematic depicting an underside view of an exemplary binding assembly in an unlocked position.
Figure 8:
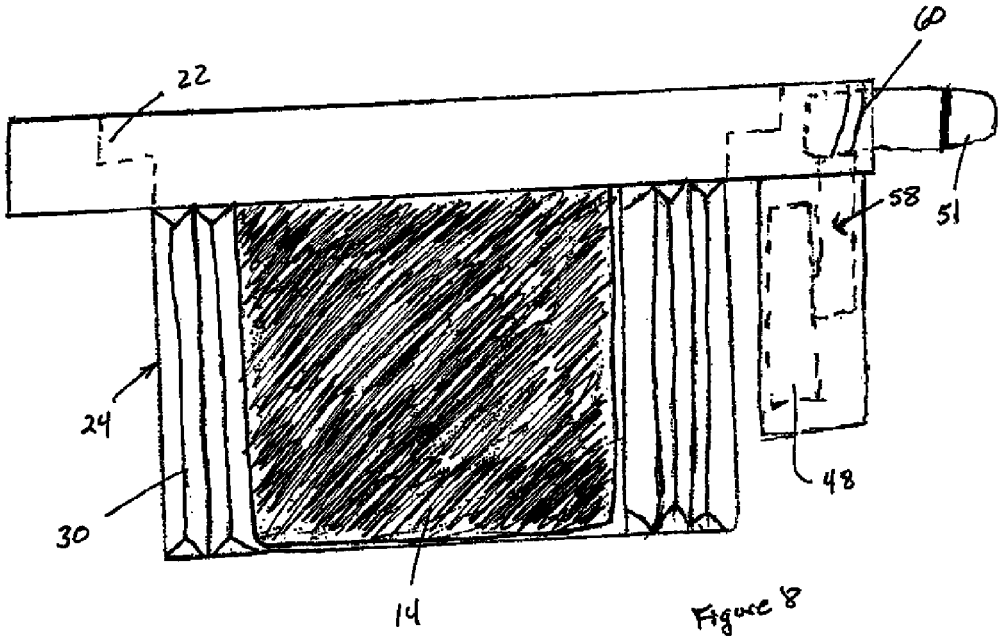
FIG. 8 is a schematic depicting a front view of an exemplary positioning unit from a heel end of an exemplary binding, wherein the binding assembly is in an unlocked position.

Referring to FIGS. 5, 7, and 8, to unlock binding 3, upper protrusion 52 is removed from port 66, and pull lever 54 is pulled outwardly in a direction away from boot platform 2. As the outwardly directed force is applied to pull lever 54, extension 56 moves outwardly from port 64 causing coil compression spring 60 to compress up against cover plate 72 thereby building up a compressive force, and extension 58 moves away from central member 24, thereby causing the dislocation of engaging member 48 from side wall 28 of central member 24. As engaging member 48 is no longer connected to side wall 28, binding 3 is free to rotate. Accordingly, a user's foot, for example, which is strapped to binding 3, may rotate, thereby causing binding 3 to rotate in the direction of the foot's rotation. Such rotation may continue until block 44 abuts stop 34 that has been positioned in a desired location.

Figure 6:
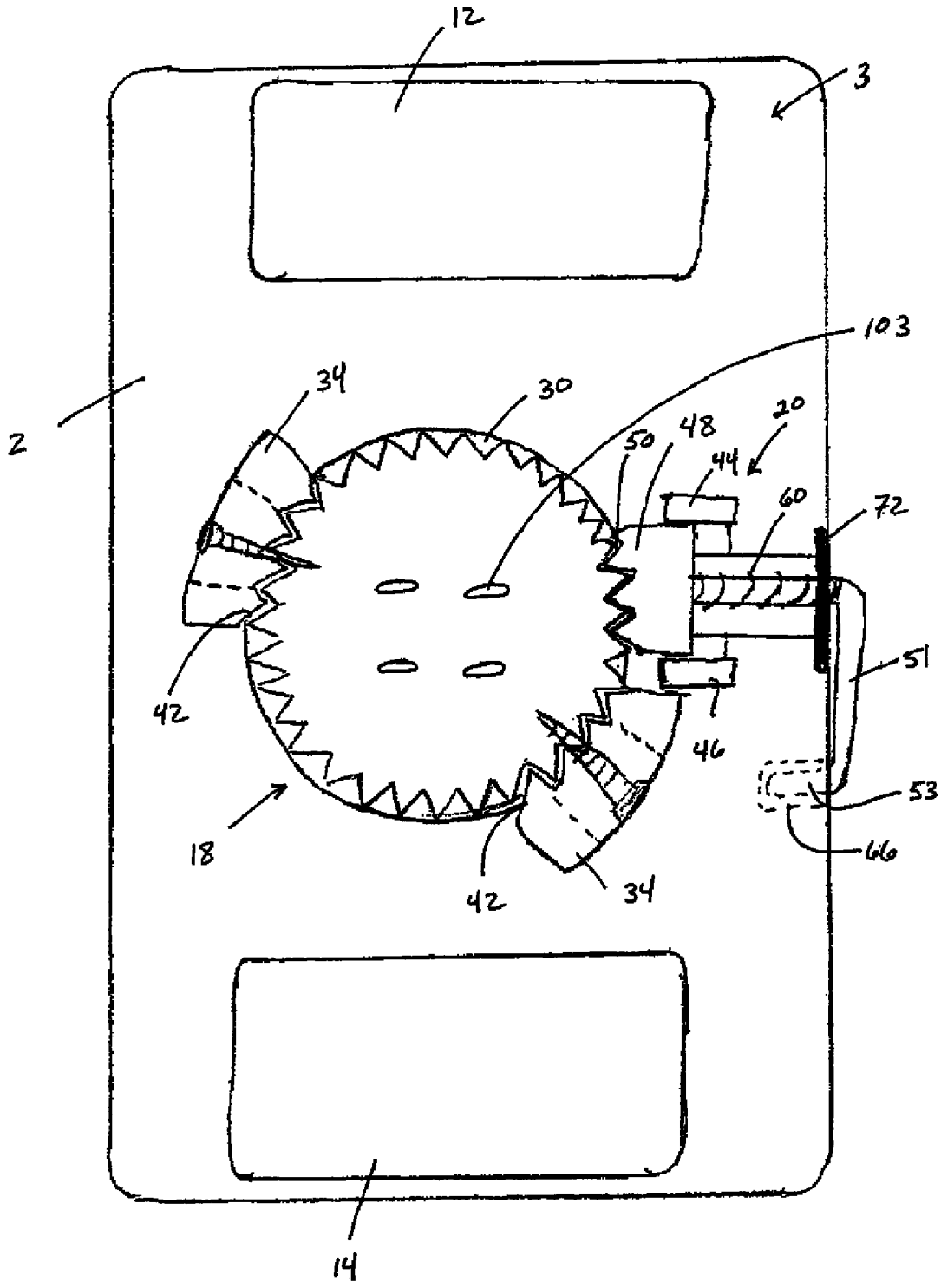
FIG. 6 is a schematic depicting an underside view of an exemplary binding assembly in a locked position.
Figure 9:
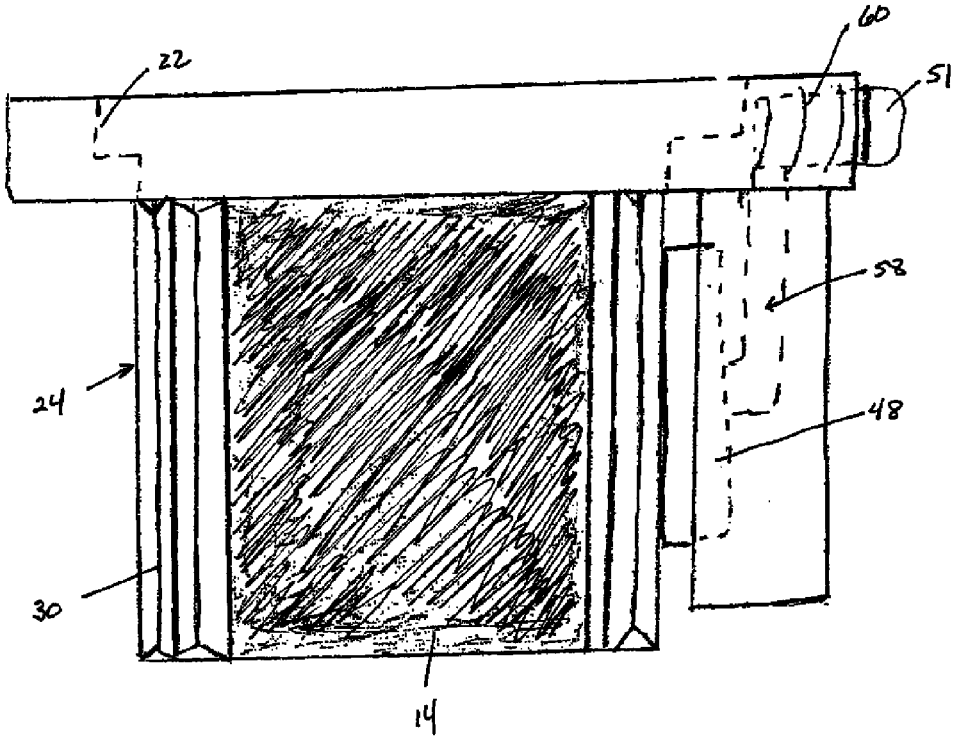
FIG. 9 is a schematic depicting a front view of an exemplary positioning unit from a heel end of an exemplary binding, wherein the binding assembly is in a locked position.

Once binding 3 has been properly positioned, pull lever 54 may then be released. Referring to FIGS. 5, 6, and 9, when released, the compressive force stored up in coil compression spring 60 moves extension 56 back towards positioning unit 16, and which, therefore causes extension 58 to move engaging member 48 back towards side wall 28 of central member 24 until plurality of ridges 42 of engaging member 48 again interconnects with plurality of grooves 30 of side wall 28. Such interconnection again locks binding assembly 1 into place. Extension 53 may then be reinserted into port 66 to contain handle 52.

The binding assembly of the present invention is an improvement over the prior art for many reasons. For example, the assembly requires less parts than is found in prior art rotatable bindings. Additionally, the variability in the position of the stops along the side wall of the central member allows a user to select a desired range of motion for the user's particular needs and preferences.

With respect to the above disclosure, it is to be realized that the invention includes variations which are deemed readily apparent and obvious to one skilled in the art, and all equivalent relationships to those described and illustrated herein are intended to be encompassed by the present invention. Therefore, the foregoing is considered as illustrative only of the principles of the invention. Further, since numerous modifications and changes will readily occur to those skilled in the art, it is not desired to limit the invention to the exact construction shown and described, and accordingly, all suitable modifications and equivalents may be resorted to, falling within the scope of the invention.

What is claimed is:

1. A binding assembly, comprising:

a binding comprising:

a boot platform comprising a side wall having an interior side opposite to an exterior side; and a positioning unit engaged with the boot platform, comprising:

an anchoring subunit comprising:

a plate disposed on top of a central member having an exterior side wall; wherein the plate is disposed within the interior side of the side wall of the boot platform and the central member extends downward from the boot platform; and one or more stops secured to the exterior side wall of the central member and protruding therefrom; and a locking subunit comprising a handle in communication with an engaging member, wherein at one moment the handle exerts a first force on the engaging member thereby causing the engaging member to move towards the central member until the engaging member makes direct physical contact with the exterior side wall of the central member at which point the handle is maneuvered to lock the binding assembly, and wherein at another moment the handle exerts a second force on the engaging member thereby causing the engaging member to detach itself from the exterior side wall of the central member, thereby unlocking the binding assembly;

wherein the binding is rotatable about a central longitudinal axis when the binding assembly is unlocked, and wherein the binding is fixed in position when the binding assembly is locked, and further wherein, the one or more stops is positioned on the exterior side wall of the central member to define a maximum distance through which the anchoring subunit can rotate when the positioning unit is unlocked, and further wherein one or more of the one or more stops is removably secured to the exterior side wall of the central member, and wherein the one or more removable stops can be positioned and removably secured elsewhere on a side of the central member such that the distance through which the anchoring subunit can rotate is variable.

2. The binding assembly of claim 1, wherein the exterior side wall of the central member comprises a screw hole, and wherein the one or more stops comprises a screw hole, wherein the screw hole of the central member is aligned with the screw hole of one of the one or more stops, and wherein the respective stop is releasably held to the central member via a screw inserted through the screw holes of the central member and the respective stop.

3. A binding assembly, comprising:

a binding comprising:

a boot platform comprising a side wall having an interior side opposite to an exterior side; and a positioning unit engaged with the boot platform, comprising:

an anchoring subunit comprising:

a plate disposed on top of a central member having an exterior side wall, wherein the plate is disposed within the interior side of the side wall of the boot platform and the central member extends downward from the boot platform, and further wherein the exterior side wall of the central member comprises a plurality of sequentially spaced grooves; and one or more stops secured to the exterior side wall of the central member and protruding therefrom; and a locking subunit comprising a handle in communication with an engaging member, wherein the engaging member comprises a side comprising a plurality of ridges complementary to the plurality of grooves of the exterior side wall of the central member such that the plurality of ridges fit within the plurality of grooves when the positioning unit is locked;

wherein at one moment the handle exerts a first force on the engaging member thereby causing the engaging member to move towards the central member until the engaging member makes direct physical contact with the exterior side wall of the central member at which point the handle is maneuvered to lock the binding assembly, and wherein at another moment the handle exerts a second force on the engaging member thereby causing the engaging member to detach itself from the exterior side wall of the central member, thereby unlocking the binding assembly;

wherein the binding is rotatable about a central longitudinal axis when the binding assembly is unlocked, and wherein the binding is fixed in position when the binding assembly is locked, and further wherein, the one or more stops is positioned on the exterior side wall of the central member to define a maximum distance through which the anchoring subunit can rotate when the positioning unit is unlocked; and further wherein:

the locking subunit further comprises a first block and a second block, and wherein the engaging member further comprises a first lateral side opposite to a second lateral side wherein the first and second lateral sides are adjacent to the side comprising the plurality of ridges, and wherein the first and second blocks abut the respective first and second lateral sides of the engaging member.

4. A binding assembly, comprising:

a binding comprising:

a boot platform comprising a side wall having an interior side opposite to an exterior side; and a positioning unit engaged with the boot platform, comprising:

an anchoring subunit comprising:

a plate disposed on top of a central member having an exterior side wall, wherein the plate is disposed within the interior side of the side wall of the boot platform and the central member extends downward from the boot platform, and further wherein the exterior side wall of the central member comprises a plurality of sequentially spaced grooves; and one or more stops secured to the exterior side wall of the central member and protruding therefrom; and a locking subunit comprising a handle in communication with an engaging member, wherein the engaging member comprises a side comprising a plurality of ridges complementary to the plurality of grooves of the exterior side wall of the central member such that the plurality of ridges fit within the plurality of grooves when the positioning unit is locked;

wherein at one moment the handle exerts a first force on the engaging member thereby causing the engaging member to move towards the central member until the engaging member makes direct physical contact with the exterior side wall of the central member at which point the handle is maneuvered to lock the binding assembly, and wherein at another moment the handle exerts a second force on the engaging member thereby causing the engaging member to detach itself from the exterior side wall of the central member, thereby unlocking the binding assembly:

wherein the binding is rotatable about a central longitudinal axis when the binding assembly is unlocked, and wherein the binding is fixed in position when the binding assembly is locked; and further wherein:

the one or more stops is positioned on the exterior side wall of the central member to define a maximum distance through which the anchoring subunit can rotate when the positioning unit is unlocked; and further wherein the handle comprises:

a pull lever comprising a main body and an upper protrusion opposite to a lower protrusion, wherein the upper and the lower protrusions are perpendicularly connected to the main body;

a first extension joined to the lower protrusion of the pull lever and lying in a same plane as the lower protrusion of the pull lever; and a second extension comprising:

a first end perpendicularly attached to the first extension and extending therefrom to terminate at a second end; and a protrusion perpendicularly connected to the second end;

wherein the engaging member is directly attached to the protrusion of the second extension.

5. The binding assembly of claim 4, wherein the side wall of the boot platform comprises a first port which extends through the interior side and the exterior side of the side wall of the boot platform, and through which the first extension is positioned.

6. The binding assembly of claim 5, further comprising a cover plate having a front surface opposite to a back surface and further comprising a throughway extending from the front and back surfaces, wherein the throughway is aligned with the first port of the boot platform, and wherein the back surface of the cover plate is attached to the exterior side of the side wall of the boot platform.

7. The binding assembly of claim 6, wherein the side wall of the boot platform further comprises a second port through which the upper protrusion of the pull lever is insertable and held.

8. The binding assembly of claim 6, wherein the handle further comprises a coil compression spring disposed around the first extension.

9. The binding assembly of claim 8, wherein the second force is created by drawing the coil compression spring towards and against the back surface of the cover plate, and wherein the first force is created by withdrawing the coil compression spring away from the back surface of the cover plate.

10. A binding assembly, comprising:

a binding comprising:

a boot platform comprising a side wall having an interior side opposite to an exterior side; and a positioning unit engaged with the boot platform, comprising:

an anchoring subunit comprising:

a plate disposed on top of a central member having an exterior side wall, wherein the plate is disposed within the interior side of the side wall of the boot platform and the central member extends downward from the boot platform, and further wherein the exterior side wall of the central member comprises a plurality of sequentially spaced grooves; and one or more stops secured to the exterior side wall of the central member and protruding therefrom; and a locking subunit comprising a handle in communication with an engaging member, wherein the engaging member comprises a side comprising a plurality of ridges complementary to the plurality of grooves of the exterior side wall of the central member such that the plurality of ridges fit within the plurality of grooves when the positioning unit is locked;

wherein at one moment the handle exerts a first force on the engaging member thereby causing the engaging member to move towards the central member until the engaging member makes direct physical contact with the exterior side wall of the central member at which point the handle is maneuvered to lock the binding assembly, and wherein at another moment the handle exerts a second force on the engaging member thereby causing the engaging member to detach itself from the exterior side wall of the central member, thereby unlocking the binding assembly;

wherein the binding is rotatable about a central longitudinal axis when the binding assembly is unlocked, and wherein the binding is fixed in position when the binding assembly is locked, and further wherein, the one or more stops is positioned on the exterior side wall of the central member to define a maximum distance through which the anchoring subunit can rotate when the positioning unit is unlocked; and further wherein:

the one or more stops comprises a face having a plurality of ridges formed thereon, wherein the plurality of ridges is engaged with the plurality of grooves of the side wall of the central member.

11. A binding assembly comprising:

a binding comprising a boot platform having a side wall comprising an interior side opposite to an exterior side and having a port formed through the interior and exterior sides thereof;

a cover plate having a front side opposite to a back side and a throughway formed through the front side and the back side thereof, wherein the back side of the cover plate is disposed on the exterior side of the side wall of the boot platform such that the port of the boot platform is aligned with the throughway of the cover plate; and a positioning unit comprising:

an anchoring subunit comprising a plate disposed on top of a central member, wherein the plate is attached to the interior side of the side wall of the boot platform, and wherein the central member extends below the boot platform and comprises an exterior side wall; and a locking subunit comprising:

a handle comprising a main body attached to a first extension via a swivel joint, and a second extension extending from the first extension in a direction opposite from the main body, wherein the first extension has a spring compression coil disposed around an outer surface of the first extension; and an engaging member, wherein the engaging member engages with the exterior side wall of the central member to restrict rotational movement of the anchoring subunit, and further wherein the engaging member is attached to the second extension;

wherein the first extension is fitted within the throughway of the cover plate the port of the central member such that the spring compression coil compresses against at least one of the back side of the cover plate and the interior side of the side wall of the boot platform when the positioning unit is in an unlocked position.

12. The binding assembly of claim 11, wherein the exterior side wall of the central member comprises a plurality of sequentially spaced grooves, and wherein the engaging member comprises a side comprising a plurality of ridges complementary to the plurality of grooves such that the plurality of ridges fit within the plurality of grooves when the positioning unit is locked.

13. The binding assembly of claim 12, further comprising a stop removably disposed on the exterior side wall of the central member, wherein the stop protrudes from the exterior side wall and defines a maximum distance through which the anchoring subunit can rotate when the positioning unit is unlocked.

* * * * *